US005681045A

United States Patent [19]

Liao

[11] Patent Number: 5,681,045

[45] Date of Patent: Oct. 28, 1997

[54] GOAL JOINT STRUCTURE

[76] Inventor: Grace Liao, 1F, No. 16, Shih-Chieh Street, Hsin Chu City, Taiwan

[21] Appl. No.: 682,836

[22] Filed: Jul. 12, 1996

[51] Int. Cl.[6] ..... A63B 63/00

[52] U.S. Cl. ..... 273/400; 473/478; 403/84; 403/92; 403/102

[58] Field of Search ..... 273/400, 401, 273/402, 127 R, 127 B, 407, 410; 473/197, 421, 439, 454, 476–478; 403/89, 92, 102, 325, 327

[56] References Cited

U.S. PATENT DOCUMENTS

| | | | |
|---|---|---|---|
| 1,180,965 | 4/1916 | Baly | 403/92 |
| 4,286,353 | 9/1981 | Roche | 403/102 |
| 4,721,306 | 1/1988 | Shewchuk | 473/478 |
| 5,178,583 | 1/1993 | Rankin | 403/102 |
| 5,370,385 | 12/1994 | Joy | 473/421 |
| 5,431,411 | 7/1995 | Padilla | 273/400 |
| 5,539,957 | 7/1996 | Schmidt | 403/102 |
| 5,566,952 | 10/1996 | Mullin et al. | 273/400 |
| 5,580,064 | 12/1996 | Childers, Jr. | 273/400 |

FOREIGN PATENT DOCUMENTS

| | | | |
|---|---|---|---|
| 1301588 | 7/1962 | France | 403/102 |
| 2636659 | 3/1990 | France . | |

*Primary Examiner*—Mark S. Graham

[57] ABSTRACT

A goal joint structure includes a first section and a second section pivoted to each other. The first section has a hook member provided thereon. The second section has two spaced walls define therebetween a distance large enough to receive therein the hook. Each of the walls has an elongated slot formed thereon to be in alignment with each other and each has two expanded lengthwise ends defined by circular holes. A retaining bar extends through the two slots and is dimensioned to be movable along the slots. An expanded section that has a diameter substantially corresponding to the circular holes and larger than the width of the slots is provided on the retaining bar. The retaining bar is spring-biased to have the expanded section located within one expanded ends of the slots so as to make the retaining bar fixed in the lengthwise direction of the slots. Pulling the retaining bar against the spring to have the expanded section disengage from the expanded end of the slots allows the retaining bar to move from one end of the slot to the other end. Rotating the first section relative to the second section to have the hook moved into between the walls of the second section and moving the retaining bar to engage the hook maintain the first section and second section in the expanded condition.

7 Claims, 9 Drawing Sheets

GOAL JOINT STRUCTURE

FIELD OF THE INVENTION

The present invention relates generally to a goal, such as a hockey goal, and in particular to a joint structure for a knock-down goal structure.

BACKGROUND OF THE INVENTION

Hockey has been a prevailing sport. A regular hockey game is played in a standard court and a puck is hit by the players into a goal. There is also the so-called "street hockey" which is played by children in any places rather than a regular hockey court. In playing the "street hockey", it needs to establish a temporal goal which should be removed once the hockey game is over.

Structures of temporal goals that are capable to remove after the games are known. One form of such known street hockey goals is made by plastic injection molding as a single unit so that it has a light weight to be carried easily, but it occupies a great space when not in use for it is not collapsible. Further, such a single piece goal structure suffers the problems that the corner joints that are subject to greater loads are easy to break and that there is no way to restore or replace the broken joint.

To overcome the problems, a collapsible goal is developed. Such a collapsible goal is usually provided with knock-down joints that are also reinforced to support greater loads. However, the conventional knock-down joint of the collapsible goal has a very complicated structure. Such a complicated structure directly leads to a high manufacturing cost and also a great chance of being damaged.

It is therefore desirable to provide an improved knock-down joint structure for use in a collapsible goal to overcome the problem suffered by the conventional goal structures.

SUMMARY OF THE INVENTION

It is therefore an object of the present invention to provide a goal joint structure which is easy to manufacture and ready to knock down.

It is another object of the present invention to provide a goal joint structure which is connected to the tubular members that are comprised of the goal with thread-locking structure so as to be strong enough to support greater load.

It is a further object of the present invention to provide a collapsible goal structure comprising tubular members connected together by means of the joints to provide a light-weighted, yet strong goal.

It s a further object of the present invention to provide a collapsible goal structure which is capable to readily collapse from a fully expanded condition to a fully collapsed condition so as to reduce the storage spaced needed.

To achieve the above objects, in accordance with an aspect of the present invention, there is provided a goal joint structure comprising a first section and a second section pivoted to each other. The first section has a hook member provided thereon. The second section has two spaced walls define therebetween a distance large enough to receive therein the hook. Each of the walls has an elongated slot formed thereon to be in alignment with each other and each has two expanded lengthwise ends defined by circular holes. A retaining bar extends through the two slots and is dimensioned to be movable along the slots. An expanded section that has a diameter substantially corresponding to the circular holes and larger than the width of the slots is provided on the retaining bar. The retaining bar is spring-biased to have the expanded section located within one expanded ends of the slots so as to make the retaining bar fixed in the lengthwise direction of the slots. Pulling the retaining bar against the spring to have the expanded section disengage from the expanded end of the slots allows the retaining bar to move from one end of the slot to the other end. Rotating the first section relative to the second section to have the hook moved into between the walls of the second section and moving the retaining bar to engage the hook maintain the first section and second section in the expanded condition.

In accordance with a second aspect of the present invention, a corner joint for a goal structure is provided, comprising a 45-degree inclined surface provided on the first section and a mating 45-degree inclined surface provided on the second section to abut against each other when the first section and the second section are brought into the expanded condition wherein the first and second sections are substantially normal to each other and maintained therein by the engagement between the hook and the retaining bar.

In accordance with a third aspect of the present invention, a central joint for a goal structure is provided, comprising a central section having two ends to which two end sections are respectively pivoted. Hook and bar engagement between the central section and each of the end sections is provided to maintain the central section and the end section substantially in line with each other.

In accordance with a fourth aspect of the present invention, a goal structure is provided comprising a number of tubes jointed together with the corner joints and the central joints to define a collapsible structure. Thread-locking connection is provided between each end of each of the tubes and the respective joint.

These and other objects and advantages of the present invention will become more apparent from a consideration of the following detailed description of preferred embodiments thereof, when read in conjunction with the accompanying drawings, wherein:

DETAILED DESCRIPTION OF THE PREFERRED EMBODIMENTS

Figure 4:
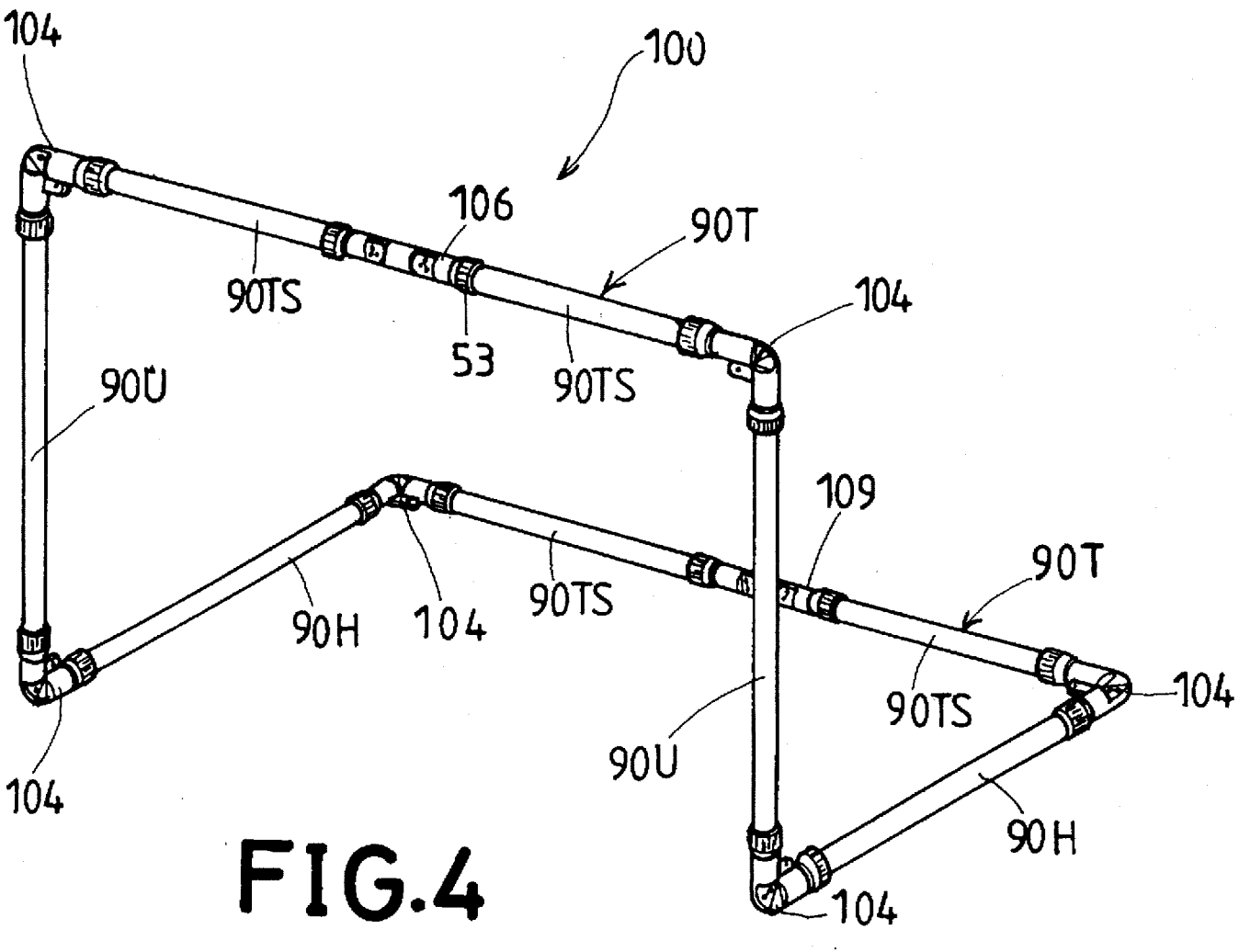
FIGS. 4, 5 and 6 are perspective views showing the knock-down sequence of the collapsible goal constructed in accordance with a first embodiment of the present invention.
Figure 5:
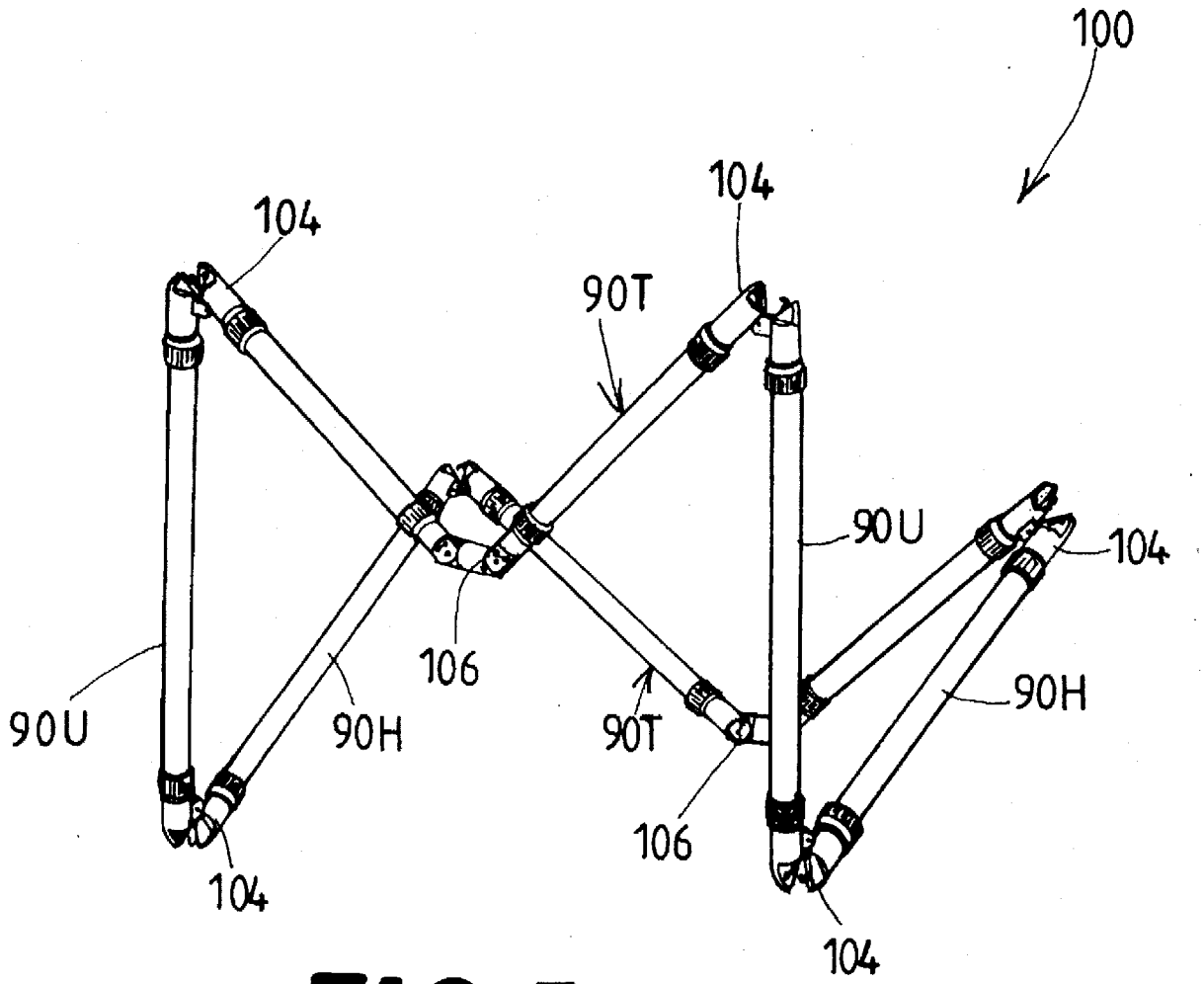
Figure 6:
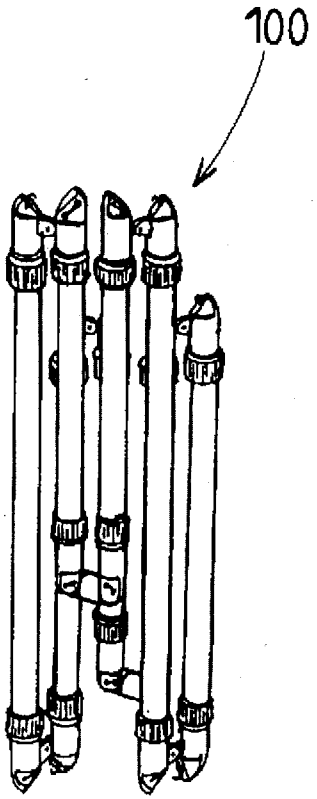

Referring to the drawings and in particular to FIGS. 4–6, wherein a goal constructed in accordance with a first embodiment of the present invention, generally designated with reference 100, is shown, the goal of the present invention comprises tubing 102 connected together by means of corner joints 104 and central joints 106, both corner joint 104 and central joint 106 having a knock-down structure, so that the goal 100 is collapsible from a fully expanded condition, shown in FIG. 4, through a partially collapsed condition shown in FIG. 5 to the final fully collapsed condition shown in FIG. 6. The collapsibility of the goal 100 allows it to be stored in a very limited space.

The generic term tubing, bearing the reference numeral 102, used herein is intended to comprise all the tubular members comprised of the goal structure 100, including upright tubes 90U, horizontal tubes 90H and transverse tube 90T. All of these tubes, although bearing different reference numerals, have the same configuration and preferably the same length so that the different reference numerals are to distinguish the different positions where these tubes are arranged, rather than to indicate that they have different structure.

In the embodiment illustrated, the goal 100 comprises two spaced upright tubes 90U, each having an upper end and a lower end. A horizontal tube 90H, which will also be referred to as lower horizontal tube, extends from the lower end of each of the upright tubes 90U. A first transverse tube 90T, which is also referred to as lower transverse tube, connects between free ends of the horizontal tubes 90H to define a lower sub-frame to be supported on for example ground. A second transverse tube 90T, which is also referred to as the upper transverse tube, extends between the upper ends of the upright tubes 90U and is connected thereto with corner joints 104. In the embodiment illustrated, the upright tubes 90U are connected to the respective horizontal tubes 90H with corner joints 104 in such a manner to define two spaced and opposite "Ls" which are connected to each other by means of the upper and lower transverse tubes 90T with two corner joints 104.

Each of the transverse tubes 90T is preferably comprised of two segments designated with reference numeral 90TS, each having a length substantially corresponding to that of the horizontal tubes 90H and the upright tubes 90U. A central joint 106 is provided to rotatably connect the two sections 90TS of each of the transverse tubes 90T in a knock-down manner.

Figure 1:
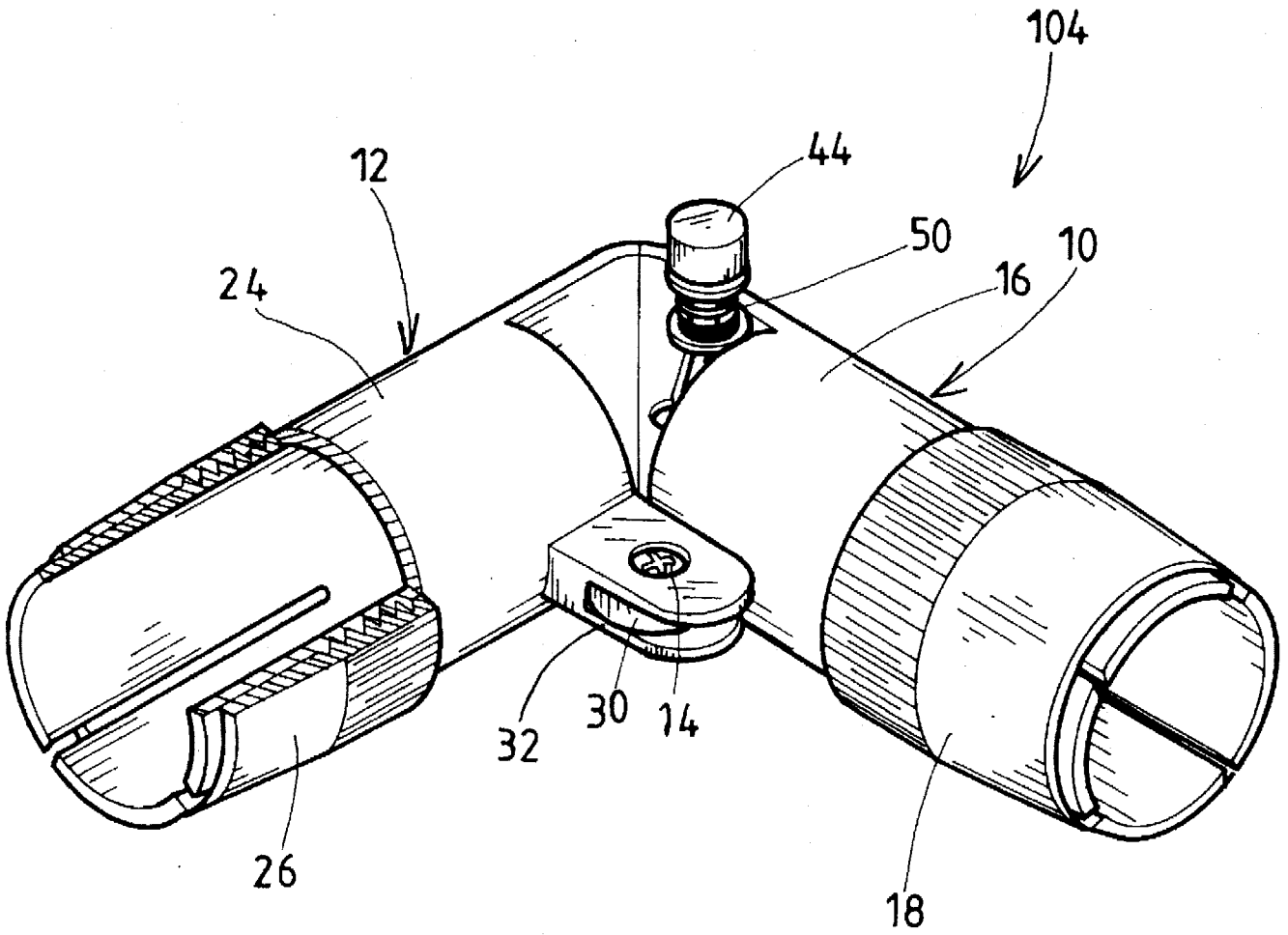
FIG. 1 is a perspective view showing a corner joint for use in a goal constructed in accordance with the present invention in the expanded condition, with a portion of the end fitting being removed to show the thread-locking structure of the end fitting.
Figures 2, 2A:
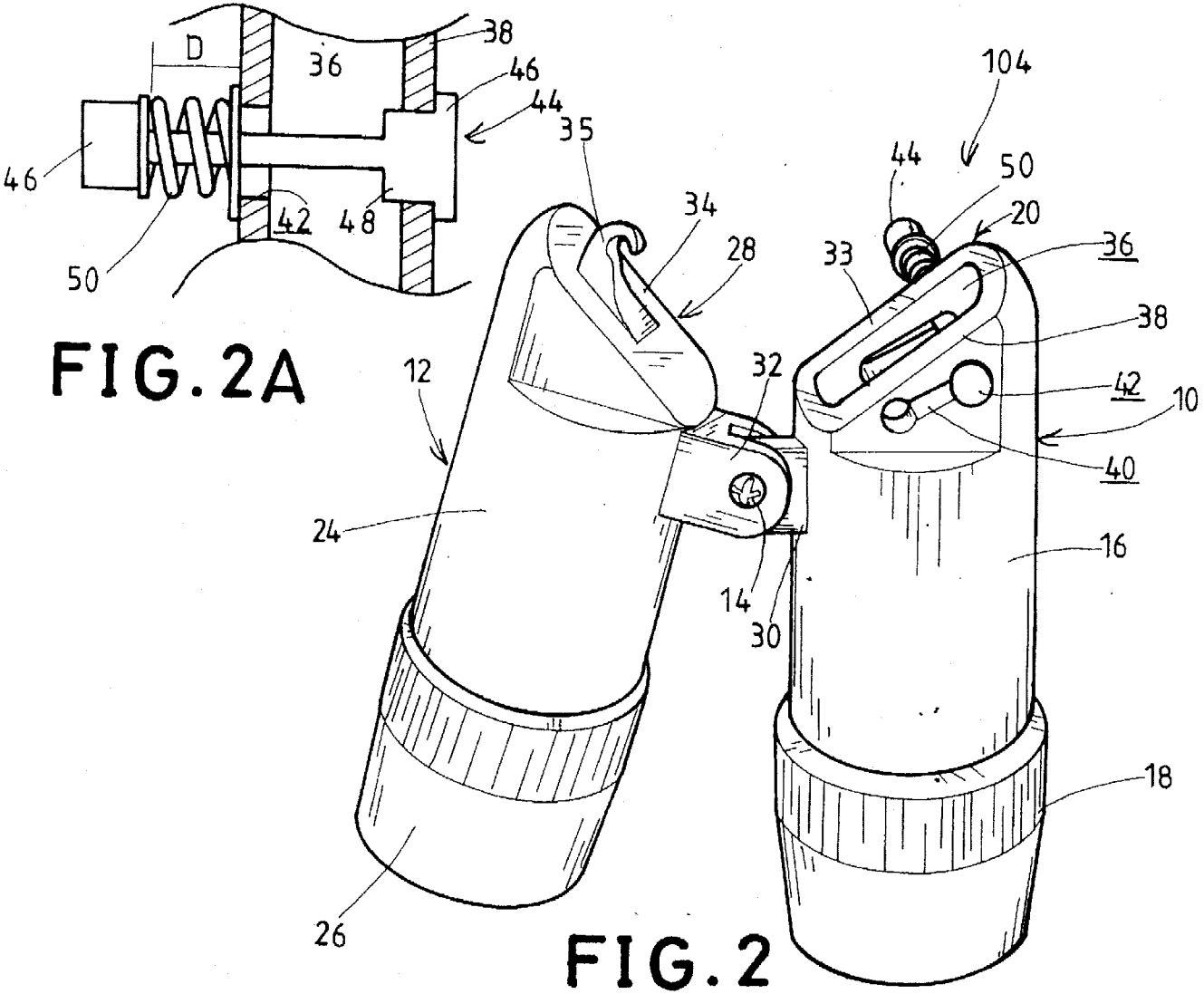
FIG. 2 is a perspective view showing the corner joint in the collapsible condition.
FIG. 2A is a partial cross-sectional view taken along the retaining bar showing the relationship between the retaining bar and the slots of the first engaging means.

With reference to FIGS. 1 and 2, wherein the corner joint 104 is shown in the expanded condition and collapsed condition, respectively, the corner joint 104 comprises a first section 10 and a second section 12, substantially identical to each other and pivoted to each other by means of a pivot pin 14.

The first section 10 comprises a tubular body 16 having an end fitting 18, preferably a thread-locking connector for securing an end of the respective tubing, as is disclosed in U.S. Pat. No. 4,948,149 issued to Joe Lin et al. on Aug. 14, 1990, provided on an outer end thereof and first engaging means 20 on an opposite inner end. The second section 12 similarly comprises a tubular body 24 having an end fitting 26 on an outer end and a counterpart, second engaging means 28 that is matingly engageable with the first engaging means 20 arranged on an inner end. Each of the first section 10 and second section 12 has a sideways lug 30 or 32 with a hole formed thereon to receive the pivot pin 14. Preferably, the lugs 30 and 32 together define a knuckle type connection, as shown in the drawings.

The second engaging means 28 comprises an inclined surface 33, preferably at 45 degrees relative to the central axis of the tubular body 16 of the first section 10. A hook 35 is provided on the inclined surface 33.

The first engaging means 20 comprises an inclined surface 34, preferably at 45 degrees relative to the central axis of the tubular body 16 of the first section 10. A recess 36 is provided on the inclined surface 34 to define a cavity having two spaced and opposite side walls 38, each having an elongated slot 40 in alignment with each other. Each of the slots 40 has two lengthwise ends that are expanded by the provision of circular holes 42 in communication with the slot 40. The holes 42 have a diameter greater than the width of the slot 40 which is the dimension of the slot 40 measured in a direction perpendicular to the length thereof.

A retaining bar 44 is slidably received within the slots 40 to be moveable along the lengthwise direction of the slots 40. The retaining bar 44 has a length greater than the distance between the two side walls 38 of the recess 36 of first engaging means to extend through the slots 40 of both walls 38 in such a manner that two ends 46 of the retaining bar 44 project out of the side walls 38 and a pre-determined distance D is established between one of the ends 46 and the corresponding side wall 38 when the other end 46 is substantially flush with the other side wall 38 so that the retaining bar 44 is also allowed to moved in a direction substantially normal to the side walls 38 and thus normal to the lengthwise direction of the slots 40.

The two ends 46 of the retaining bar 44 are expanded and have a size larger than the diameter of the end holes 42 so as to keep the retaining bar 44 within the slot 40. The retaining bar 44 also has an expanded section 48 formed inboard and preferably immediately adjacent to one of the ends 46 of the retaining bar 44. The expanded section 48 preferably assumes a circular cross section having a diameter substantially corresponding to that of the circular holes 42, but smaller than the width of the slot 40 so that when the expanded section 48 is located within the circular hole 42, the retaining bar 44 is prevented from moving along the slots 40.

Biasing means, such as a spring 50, is provided between the other one of the ends 46 which has no expanded section 48 associated therewith and the corresponding side wall 38 to bias and maintain the expanded section 48 in one of the circular holes 42. This prevents the retaining bar 44 from moving along the slots 40.

The expanded section 48 has a lengthwise dimension substantially equal to the value of the distance D so that the retaining bar 44 is movable in the second direction, against the spring 50, to have the expanded section 48 disengages from the circular holes 42 and thus allowing the retaining bar 44 to move along the slots 40 from one end hole 42 of the slots 40 to the opposite end hole 42.

In operation, the second section 12 is rotated about the pivot 14 toward the first section 10 to have the hook 35 move into the recess 36 and the inclined surfaces 34 and 33 abut against each other. The retaining bar 44 is then moved in such a manner to engage the hook 35 so as to maintain the inclined surfaces 33 and 34 in abutting engagement and hold the corner joint 104 in the expanded condition.

To release the corner joint 104, the retaining bar 44 is moved against the spring 50 to disengage the expanded section 48 from one of the end holes 42 of the slots 40 and then moved along the slots 40 for releasing from the hook 35. The second section 12 of the corner joint 104 is then allowed to rotate away from the first second 10 and the corner joint 104 is released.

Figure 3:
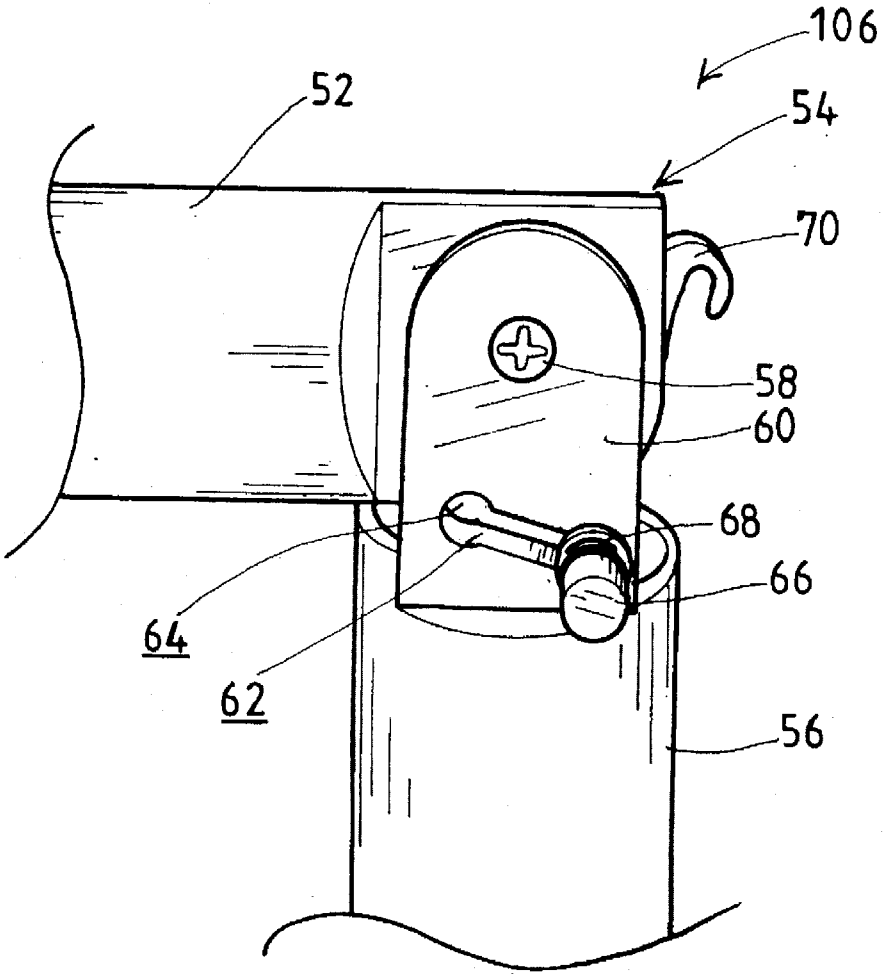
FIG. 3 is a perspective view showing a central joint for use in a goal constructed in accordance with the present invention in the partially collapsible condition.

The central joint 106 comprises a central section 52, see FIG. 3, extending in an axial direction and having two axial ends 54, to which two end sections 56 are pivoted with pivot pins 58. Since the two end sections 56 are identical, only half of the central section 52 and a portion of one of the end sections 56 is shown in FIG. 3. A thread-locking type end fitting 53 (FIGS. 4 and 5), similar to that of the corner joint 104, is mounted to a free end of each of the end sections 56, for securing an end of the respectively tubing 102. Preferably the axial end of the central section 52 defines a plate-like section sandwiched between two opposite, spaced walls 60 (only one visible) provided on the respective end section 56 with the pivot pin 58 extending therethrough to form a knuckle structure.

Similar to the corner joint 104, the central joint 106 has an elongated slot 62 provided on each of the walls 60 of the end section 56 and in alignment with each other, each slot 62 having two expanded end holes 64 to receive therein a retaining bar 66, similar to the retaining bar 44 of the corner joint 104 and having two expanded ends and an expanded inboard section (not labelled in FIG. 3, but imaginable from FIG. 2A) corresponding to the end holes 64 in size. The retaining bar 66 is biased by a spring 68 to be fixed in one of the end holes 64. A hook 70 is provided on the axial end 54 of the central section 52 to be receivable within the spacing between the walls 60 of the end section 56 to be engageable with the retaining bar 68 which is movable along the slots 62 from one of the end holes 64 to the other so as to retain the end section 56 in an expanded position relative to the central section S2.

The operation of the central joint 106 is similar to that of the corner joint 104 and the previous description of the operation and releasing of the corner joint 104 also applies to the central joint 106.

The collapse of the goal 100 in accordance with the first embodiment of the present invention is shown in FIGS. 4–6.

Figure 7A:
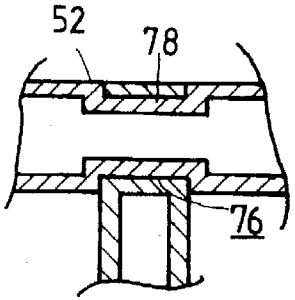
FIG. 7A is a partial cross-sectional view showing the pivotal connection between the reinforcing tube and the transverse tube.
Figure 7:
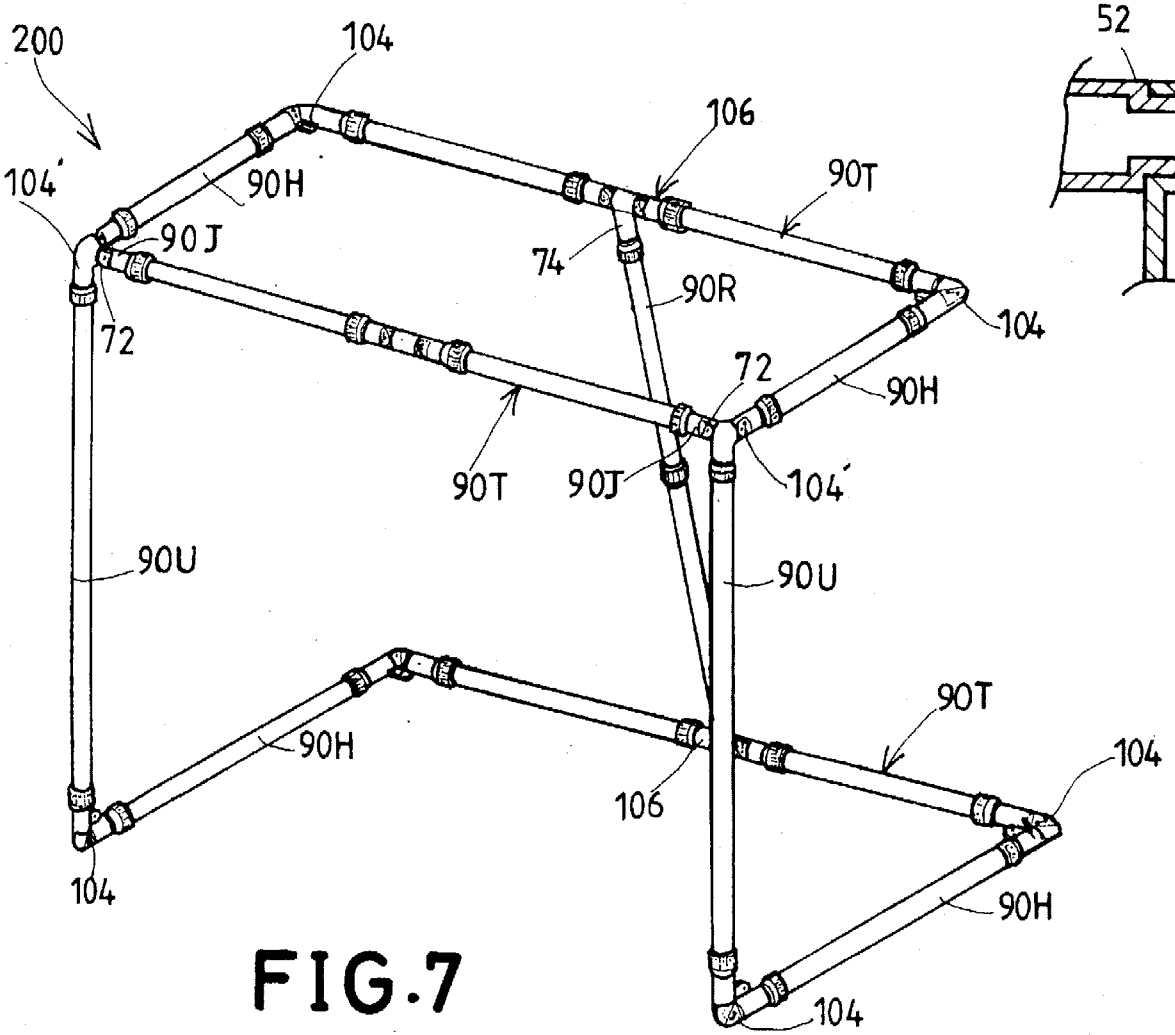
FIGS. 7, 8 and 9 are perspective views showing the knock-down sequence of the collapsible goal constructed in accordance with a second embodiment of the present invention.

In FIG. 7, a second embodiment of the goal constructed in accordance with the present invention, generally designated with reference numeral 200, is shown. The goal 200 is in general the same as that shown in FIGS. 4–6, but having an additional upper sub-frame which includes two further horizontal tubes 90H, referred to as the upper horizontal tubes, extending from the upper ends of the upright tubes 90U in a manner substantially parallel with the lower horizontal tubes, and a third transverse tube 90T connected between the free ends of the upper horizontal tubes 90U with two corner joints 104.

The corner joints 104 that are used to joint the upper ends of the upright tubes 90U to the second transverse tube 90T in the first embodiment goal 100 are replaced by modified corner joints 104' which have the same structure as the primary corner joint 104, but, in the embodiment illustrated in FIG. 7, are oriented in such a manner to joint the upper ends of the upright tubes 90U and the respective upper horizontal tubes 90H. A sideways lug 72 extends from each of the modified corner joint 104' to be pivoted to a junction member 90J, see FIG. 7. The junction member 90J also comprises a tubular section to be fixed to one of the segments of the second transverse tube 90T by means of the thread-locking structure. This allow the second transverse tube 90T to be rotatable relative to the modified corner joints 104'.

It is also possible to orient the modified corner joints 104' the same as the primary corner joints 104 to connect the upright tubes 90U and the second transverse tube 90T (similar to the first embodiment), while the lugs 72 extending in the direction of the upper horizontal tubes 90T to pivotally connect the upper horizontal tubes 90H with the junction members 90J.

A reinforced tube 90R is connected between the central joints 106 of the first and third transverse tubes 90T in such a manner to be rotatable relative to the central joints 106 thereof about central axes of the central joints 106. An example of the rotatable connection between the reinforced tube 90R and the central joints 106 of the first and third transverse tubes 90T is shown in FIG. 7A and is described as follows.

Each of the first and third transverse tubes 90T comprises two segments, jointed together with the central joint 106. As mentioned above, the central joint 106 comprises a central section 52 and two end sections 56 rotatable relative to the central section 52 and releasably engageable therewith. The reinforced tube 90R comprises a central tubular member secured to two end members 74 by means of thread-locking connections, FIG. 7. Each of end members 74 comprises a collar defining a bore 76 having an axis extending parallel with the central axis of the central section 52 of the central joint 106 and fit over the central section 52 in a relatively rotatable manner. Preferably, the central section 52 comprises a circumferential groove 78 corresponding to and fit into the bore 76 of the end member 74 to make the end member 74 axially fixed along the central section 52 of the central joint 106 but rotatable about the central section 52, as shown in FIG. 7.

Figure 8:
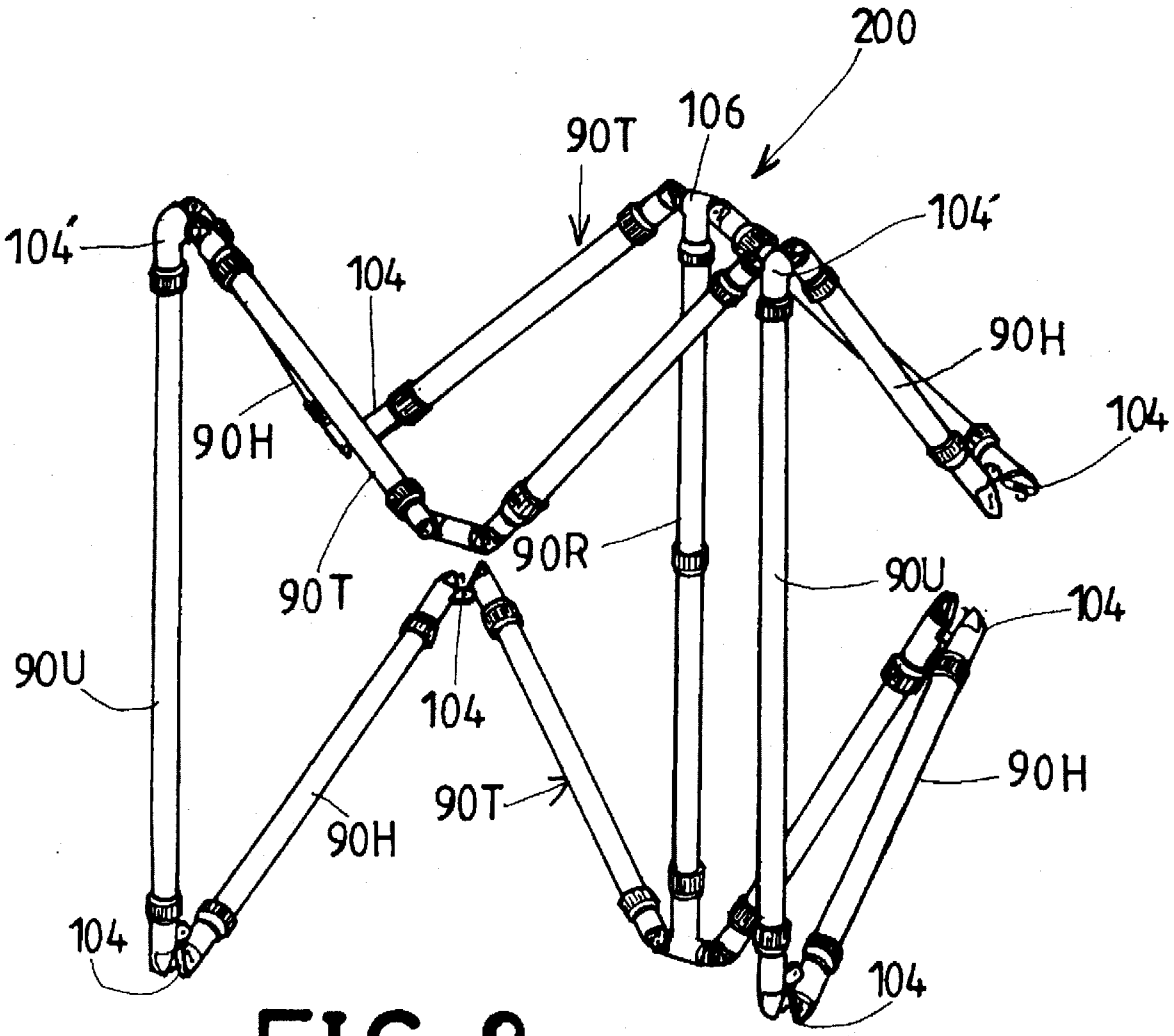
Figure 9:
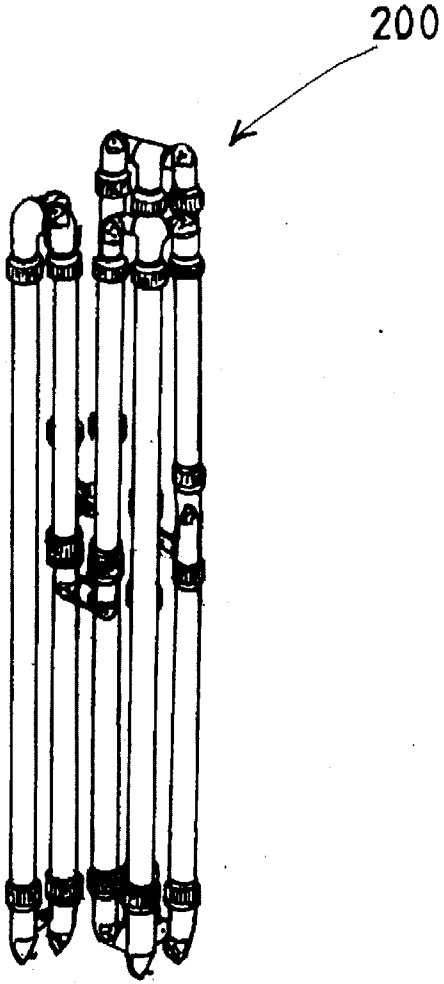

Similar to FIGS. 4–6 that show the collapse of the first embodiment goal 100, FIGS. 7, 8 and 9 show the collapse of the second embodiment goal 200 of the present invention.

Those skilled in the art will readily recognize that various modifications of the present invention may be made without departing the scope of the present invention defined in the appended claims. Accordingly the preferred embodiments illustrated and discussed herein should be understood to be exemplary only in nature and the scope of the instant invention should be limited only by that of the following claims.

What is claimed is:

1. A joint structure for use in a goal comprised of elongated tubes to joint two of the tubes, the joint structure comprising at least one first section having a first end on which a hook is formed and one second section pivoted to the first end of the first section so as to allow the second section to be rotatable relative to the first section between a collapsed condition and an expanded condition, the second section having two spaced and opposite walls formed thereon defining therebetween a spacing into which the hook is receivable, each of the walls having an elongated slot of a predetermined width formed thereon and in alignment with each other, the slot having two lengthwise ends, each being expanded to define a circular hole in communication with the slot and having a diameter larger than the width of the slot, an elongated bar, received within the slots to be movable in the length of the slots and at least partially projecting out of the walls a predetermined distance, the bar having an expanded section having a cross-sectional shape and size corresponding to the circular holes, biasing means being provided between the bar and one of the walls to maintain the bar in a first position wherein the expanded section is located within one of the circular holes to prevent the bar from moving along the slots, while allowing the bar to be movable in lengthwise direction of the bar a distance substantially equal to the predetermined distance to a second position wherein the expanded section of the bar is disengaged from the circular hole to allow the bar to move along the slots so that by rotating the first section toward the second section to have the hook move between the walls and moving the bar along the slots from one of the circular holes to the opposite circular holes to engage the hook, the first section and the second section are maintained in the expanded condition.

2. The joint structure as claimed in claim 1, wherein the first section and the second section both comprise an inclined surface facing each other so that when the first and section sections are in the expanded condition, the inclined surfaces abut each other to define an included angle between the first section and the second section.

3. The joint structure as claimed in claim 2, wherein the included angle is approximately 90 degrees.

4. The joint structure as claimed in claim 1, wherein the first section further comprises a second hook provided on a second end, that is opposite to the first end, and wherein the joint structure further comprises a third section, identical to the second section, pivoted to the second end of the first section to be rotatable relative thereto between an expanded condition and a collapsed condition.

5. A goal structure comprising:

two spaced and opposite upright tubes each having an upper end and a lower end;

a lower sub-frame comprising:

a pair of lower horizontal tubes each having a first end rotatably connected to the lower end of each of the upright tubes by means of a first corner joint and an opposite second end, a first transverse tube connected between the second ends of the lower horizontal tubes, with first corner joints, the first transverse tube comprising two segments rotatably jointed together with a central joint; and an upper sub-frame comprising a second transverse tube connected between the upper ends of the upright tubes with second corner joints, the second transverse tube comprising two segments rotatably jointed together by means of a central joint;

wherein the first corner joint comprises a first section having a first end on which a hook is formed and a second section pivoted to the first end of the first section so as to allow the second section to be rotatable relative to the first section between a collapsed condition and an expanded condition, each of the first and second sections being provided with a thread-locking end fitting to secure an end of a respective tube, the second section having two spaced and opposite walls formed thereon defining therebetween a spacing into which the hook is receivable, each of the walls having an elongated slot of a predetermined width formed thereon and in alignment with each other, the slot having two lengthwise ends, each being expanded to define a circular hole in communication with the slot and having a diameter larger than the width of the slot, an elongated bar received within the slots to be movable in the length of the slot and at least partially projecting out of the walls a predetermined distance, the bar having an expanded section having a cross-sectional shape and size corresponding to the circular holes, biasing means being provided between the bar and one of the walls to maintain the bar in a first position wherein the expanded section is located within one of the circular holes to prevent the bar from moving along the slots, while allowing the bar to be movable in lengthwise direction of the bar a distance substantially equal to the predetermined distance to a second position wherein the expanded section of the bar is disengaged from the circular hole to allow the bar to move along the slots so that by rotating the first section toward the second section to have the hook move between the walls and moving the bar along the slots from one of the circular holes to the opposite circular holes to engage the hook, the first section and the second section are maintained in the expanded condition, the first section and the second section both comprising an inclined surface facing each other so that when the first and section sections are in the expanded condition, the inclined surfaces abut each other to define a 90° included angle between the first section and the second section; and wherein the central joint comprises a central section having two opposite ends on each of which a hook is formed and an end section pivoted to each of the ends of the central section so as to allow the end sections to be rotatable relative to the central section between a collapsed condition and an expanded condition, each of the end sections being provided with a thread-locking end fitting to secure an end of a respective tube, each of the end sections having two spaced and opposite walls formed thereon defining therebetween a spacing into which the hook is receivable, each of the walls having an elongated slot of a predetermined width formed thereon and in alignment with each other, the slot having two lengthwise ends, each being expanded to define a circular hole in communication with the slot and having a diameter larger than the width of the slot, an elongated bar received within the slots to be movable in the length of the slot and at least partially projecting out of the walls a predetermined distance, the bar having an expanded section having a cross-sectional shape and size corresponding to the circular holes, biasing means being provided between the bar and one of the walls to maintain the bar in a first position wherein the expanded section is located within one of the circular holes to prevent the bar from moving along the slots, while allowing the bar to be movable in lengthwise direction of the bar a distance substantially equal to the predetermined distance to a second position wherein the expanded section of the bar is disengaged from the circular hole to allow the bar to move along the slots so that by rotating the first section toward the second section to have the hook move into between the walls and moving the bar along the slot from one of the circular holes to the opposite circular holes to engage the hook, the end sections are maintained in the expanded condition relative to the central section, the slots and hooks being so configured and dimensioned so that when the central joint is in the expanded condition, a 180° included angle is defined between the two end sections.

6. The goal structure as claimed in claim 5, wherein the upper sub-frame further comprises a pair of upper horizontal tubes each having a first end rotatably connected to the upper end of each of the upright tubes respectively with the second corner joints respectively and substantially parallel with the respective lower horizontal tubes, each of the upper horizontal tubes having a second end to which an end of a third transverse tube is rotatably connected by means of a first corner joint, the third transverse tube having two segments rotatably jointed together by means of a central joint.

7. The goal structure as claimed in claim 6, further comprising a reinforced tube extending between the central joints of the first and third transverse tubes, the reinforced tube having two opposite ends on each of which a collar is formed to rotatably fit over the central section of the central joint of the respective transverse joints.

* * * * *